US008235514B2

(12) United States Patent
Murray

(10) Patent No.: US 8,235,514 B2
(45) Date of Patent: Aug. 7, 2012

(54) AIR EXTRACTION DEVICE FOR INKJET PRINTHEAD

(75) Inventor: Richard A. Murray, San Diego, CA (US)

(73) Assignee: Eastman Kodak Company, Rochester, NY (US)

( * ) Notice: Subject to any disclaimer, the term of this patent is extended or adjusted under 35 U.S.C. 154(b) by 346 days.

(21) Appl. No.: 12/614,476

(22) Filed: Nov. 9, 2009

(65) Prior Publication Data

US 2011/0109706 A1 May 12, 2011

(51) Int. Cl.
*B41J 2/175* (2006.01)

(52) U.S. Cl. ..... 347/87; 347/86

(58) Field of Classification Search ..... 347/84, 347/85, 86, 87, 92
See application file for complete search history.

(56) References Cited

U.S. PATENT DOCUMENTS

| | | | | |
|---|---|---|---|---|
| 4,771,295 | A * | 9/1988 | Baker et al. | 347/87 |
| 5,801,737 | A * | 9/1998 | Sato et al. | 347/86 |
| 5,936,650 | A * | 8/1999 | Ouchida et al. | 347/89 |
| 6,116,726 | A | 9/2000 | Driggers | |
| 6,428,152 | B1 | 8/2002 | Hollands | |
| 6,457,820 | B1 * | 10/2002 | Cai et al. | 347/92 |
| 7,410,248 | B2 | 8/2008 | Umeda et al. | |
| 7,651,184 | B2 * | 1/2010 | Nakamura et al. | 347/6 |
| 2002/0097307 | A1 | 7/2002 | Tsukuda | |
| 2007/0070138 | A1 | 3/2007 | Hattori et al. | |
| 2008/0204506 | A1 | 8/2008 | Nakamura et al. | |

FOREIGN PATENT DOCUMENTS

| | | | |
|---|---|---|---|
| EP | 1 359 026 | A1 | 11/2003 |
| EP | 1 541 359 | A1 | 6/2005 |
| WO | WO 2004/069545 | A1 | 8/2004 |

* cited by examiner

*Primary Examiner* — Anh T. N. Vo
(74) *Attorney, Agent, or Firm* — Eugene I. Shkurko

(57) ABSTRACT

An inkjet printhead assembly comprising an array of nozzles fed by a corresponding ink inlet. An ink chamber corresponding to the array of nozzles is fluidly connected to the ink inlet. An air extraction chamber includes an air chamber, a one-way relief valve having an open position that allows venting of the air chamber to ambient, and a closed position that does not allow venting of the air chamber to ambient. A compressible member forces air to be vented from the air chamber through the one-way relief valve in its open position. It also applies a reduced air pressure to a membrane while the one-way relief valve is in its closed position.

19 Claims, 9 Drawing Sheets

AIR EXTRACTION DEVICE FOR INKJET PRINTHEAD

CROSS-REFERENCE TO RELATED APPLICATIONS

Reference is made to commonly assigned, co-pending U.S. Patent Applications:

U.S. patent application Ser. No. 12/614,481 filed herewith, entitled: "AIR EXTRACTION PRINTER", by Richard A. Murray, the disclosure of which is incorporated by reference herein in its entirety; and U.S. patent application Ser. No. 12/614,483 filed herewith, entitled: "AIR EXTRACTION METHOD FOR INKJET PRINTER", by Richard A. Murray, the disclosure of which is incorporated by reference herein in its entirety; and U.S. patent application Ser. No. 12/614,487 filed herewith, entitled: "INK CHAMBERS FOR INKJET PRINTER", by Richard A. Murray; the disclosure of which is incorporated by reference herein in its entirety.

FIELD OF THE INVENTION

This invention relates generally to the field of inkjet printing, and in particular to an air extraction device for removing air from the printhead while in the printer.

BACKGROUND OF THE INVENTION

An inkjet printing system typically includes one or more printheads and their corresponding ink supplies. A printhead includes an ink inlet that is connected to its ink supply and an array of drop ejectors, each ejector including an ink pressurization chamber, an ejecting actuator and a nozzle through which droplets of ink are ejected. The ejecting actuator may be one of various types, including a heater that vaporizes some of the ink in the chamber in order to propel a droplet out of the nozzle, or a piezoelectric device that changes the wall geometry of the ink pressurization chamber in order to generate a pressure wave that ejects a droplet. The droplets are typically directed toward paper or other print medium (sometimes generically referred to as recording medium or paper herein) in order to produce an image according to image data that is converted into electronic firing pulses for the drop ejectors as the print medium is moved relative to the printhead.

Motion of the print medium relative to the printhead can consist of keeping the printhead stationary and advancing the print medium past the printhead while the drops are ejected. This architecture is appropriate if the nozzle array on the printhead can address the entire region of interest across the width of the print medium. Such printheads are sometimes called pagewidth printheads. A second type of printer architecture is the carriage printer, where the printhead nozzle array is somewhat smaller than the extent of the region of interest for printing on the print medium and the printhead is mounted on a carriage. In a carriage printer, the print medium is advanced a given distance along a print medium advance direction and then stopped. While the print medium is stopped, the printhead carriage is moved in a carriage scan direction that is substantially perpendicular to the print medium advance direction as the drops are ejected from the nozzles. After the carriage has printed a swath of the image while traversing the print medium, the print medium is advanced, the carriage direction of motion is reversed, and the image is formed swath by swath.

Inkjet ink includes a variety of volatile and nonvolatile components including pigments or dyes, humectants, image durability enhancers, and carriers or solvents. A key consideration in ink formulation and ink delivery is the ability to produce high quality images on the print medium. Image quality can be degraded if air bubbles block the small ink passageways from the ink supply to the array of drop ejectors. Such air bubbles can cause ejected drops to be misdirected from their intended flight paths, or to have a smaller drop volume than intended, or to fail to eject. Air bubbles can arise from a variety of sources. Air that enters the ink supply through a non-airtight enclosure can be dissolved in the ink, and subsequently be exsolved (i.e. come out of solution) from the ink in the printhead at an elevated operating temperature, for example. Air can also be ingested through the printhead nozzles. For a printhead having replaceable ink supplies, such as ink tanks, air can also enter the printhead when an ink tank is changed.

In a conventional inkjet printer, a part of the printhead maintenance station is a cap that is connected to a suction pump, such as a peristaltic or tube pump. The cap surrounds the printhead nozzle face during periods of nonprinting in order to inhibit evaporation of the volatile components of the ink. Periodically, the suction pump is activated to remove ink and unwanted air bubbles from the nozzles. This pumping of ink through the nozzles is not a very efficient process and wastes a significant amount of ink over the life of the printer. Not only is ink wasted, but in addition, a waste pad must be provided in the printer to absorb the ink removed by suction. The waste ink and the waste pad are undesirable expenses. In addition, the waste pad takes up space in the printer, requiring a larger printer volume. Furthermore the waste ink and the waste pad must be subsequently disposed. Also, the suction operation can delay the printing operation What is needed is an air extraction device for an inkjet printhead that can remove air with little or no waste of ink, that is compatible with a compact printer architecture, that is low cost, that is environmentally friendly, and that does not delay the printing operation.

SUMMARY OF THE INVENTION

A preferred embodiment of the present invention includes an inkjet printhead assembly comprising an array of nozzles fed by a corresponding ink inlet. An ink chamber corresponding to the array of nozzles is fluidly connected to the ink inlet. An air extraction chamber includes an air chamber, a one-way relief valve having an open position that allows venting of the air chamber to ambient, and a closed position that does not allow venting of the air chamber to ambient. A compressible member forces air to be vented from the air chamber through the one-way relief valve in its open position. It also applies a reduced air pressure to a membrane while the one-way relief valve is in its closed position. The membrane is permeable to air but not to liquids. The air extraction chamber in this embodiment has an air expulsion portion of the air chamber disposed proximate the one-way relief valve, an air accumulation portion of the air chamber, and a one-way containment valve between the air accumulation portion and the air expulsion portion. The valve has an open position that allows air to pass between the air accumulation portion and the air expulsion portion, and a closed position. The one-way containment valve is movable to its open position by expansion of the compressible member. A dismountable ink tank includes a port connected to the ink chamber inlet port.

Another preferred embodiment of the present invention comprises a container with two portions. The first liquid holding portion includes a supply opening for supplying the liquid. The second portion includes a valved opening for admitting gas therein from the first portion. Another valved opening releases gas from second portion under pressure. The first valved opening does not permit gas to reenter the first portion. Yet another opening in the second portion is used for forcibly moving the gas into and out of the second portion of the container. One aspect of this action involves a suction for reducing pressure in the second portion. Another aspect of this action involves pushing gas out of the valved opening for releasing gas from the second portion.

These, and other, aspects and objects of the present invention will be better appreciated and understood when considered in conjunction with the following description and the accompanying drawings. It should be understood, however, that the following description, while indicating preferred embodiments of the present invention and numerous specific details thereof, is given by way of illustration and not of limitation. Many changes and modifications may be made within the scope of the present invention without departing from the spirit thereof, and the invention includes all such modifications. The figures below are not intended to be drawn to any precise scale with respect to size, angular relationship, or relative position.

DETAILED DESCRIPTION OF THE INVENTION

Figure 1:
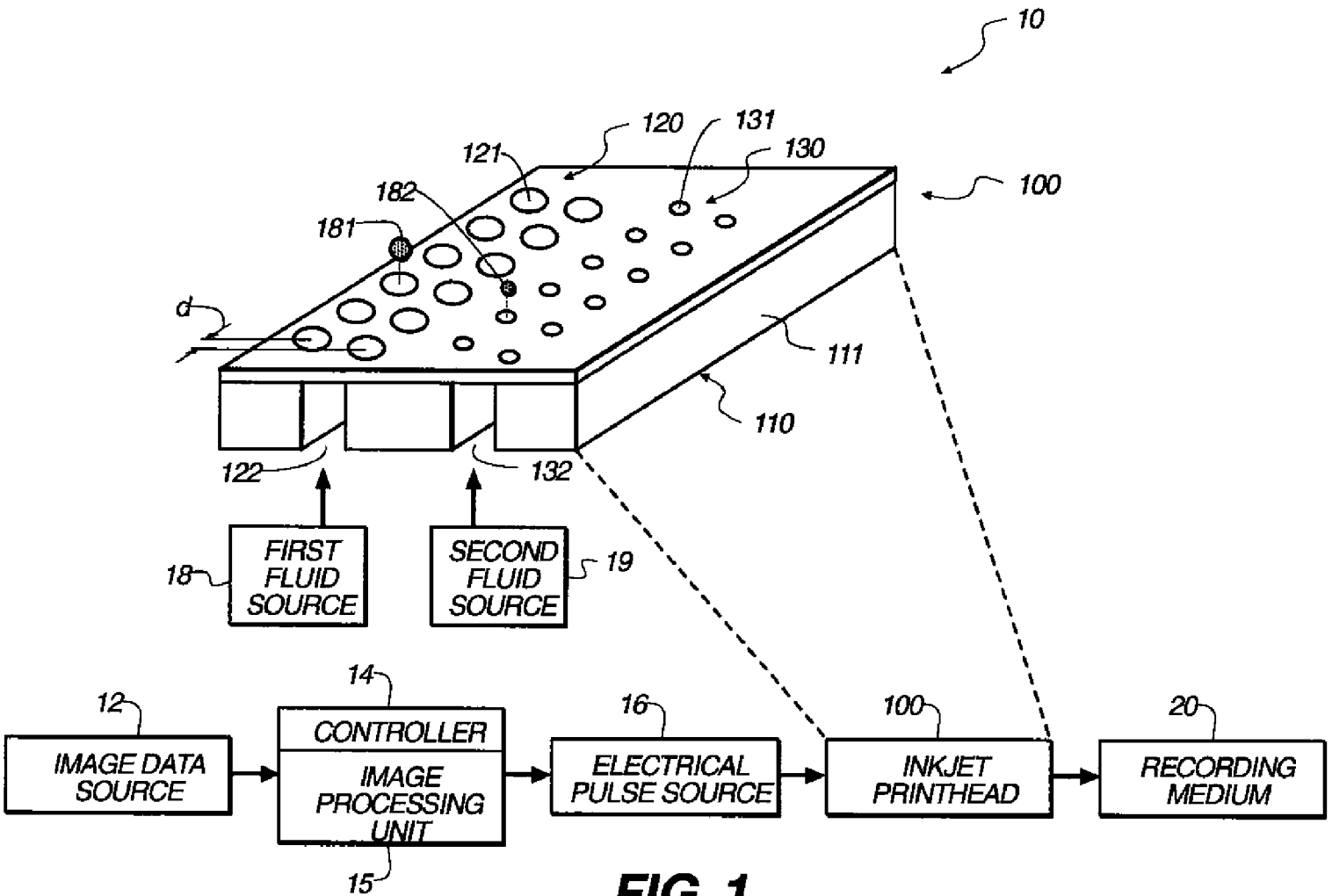
FIG. 1 is a schematic representation of an inkjet printer system.

Referring to FIG. 1, a schematic representation of an inkjet printer system 10 is shown, for its usefulness with the present invention and is fully described in U.S. Pat. No. 7,350,902, which is incorporated by reference herein in its entirety. Inkjet printer system 10 includes an image data source 12, which provides data signals that are interpreted by a controller 14 as being commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110.

In the example shown in FIG. 1, there are two nozzle arrays. Nozzles 121 in the first nozzle array 120 have a larger opening area than nozzles 131 in the second nozzle array 130. In this example, each of the two nozzle arrays has two staggered rows of nozzles, each row having a nozzle density of 600 per inch. The effective nozzle density then in each array is 1200 per inch (i.e. d=1/1200 inch in FIG. 1). If pixels on the recording medium 20 were sequentially numbered along the paper advance direction, the nozzles from one row of an array would print the odd numbered pixels, while the nozzles from the other row of the array would print the even numbered pixels.

In fluid communication with each nozzle array is a corresponding ink delivery pathway. Ink delivery pathway 122 is in fluid communication with the first nozzle array 120, and ink delivery pathway 132 is in fluid communication with the second nozzle array 130. Portions of ink delivery pathways 122 and 132 are shown in FIG. 1 as openings through printhead die substrate 111. One or more inkjet printhead die 110 will be included in inkjet printhead 100, but for greater clarity only one inkjet printhead die 110 is shown in FIG. 1. The printhead die are arranged on a support member as discussed below relative to FIG. 2. In FIG. 1, first fluid source 18 supplies ink to first nozzle array 120 via ink delivery pathway 122, and second fluid source 19 supplies ink to second nozzle array 130 via ink delivery pathway 132. Although distinct fluid sources 18 and 19 are shown, in some applications it may be beneficial to have a single fluid source supplying ink to both the first nozzle array 120 and the second nozzle array 130 via ink delivery pathways 122 and 132 respectively. Also, in some embodiments, fewer than two or more than two nozzle arrays can be included on printhead die 110. In some embodiments, all nozzles on inkjet printhead die 110 can be the same size, rather than having multiple sized nozzles on inkjet printhead die 110.

Not shown in FIG. 1, are the drop forming mechanisms associated with the nozzles. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20. As the nozzles are the most visible part of the drop ejector, the terms drop ejector array and nozzle array will sometimes be used interchangeably herein.

Figure 2:
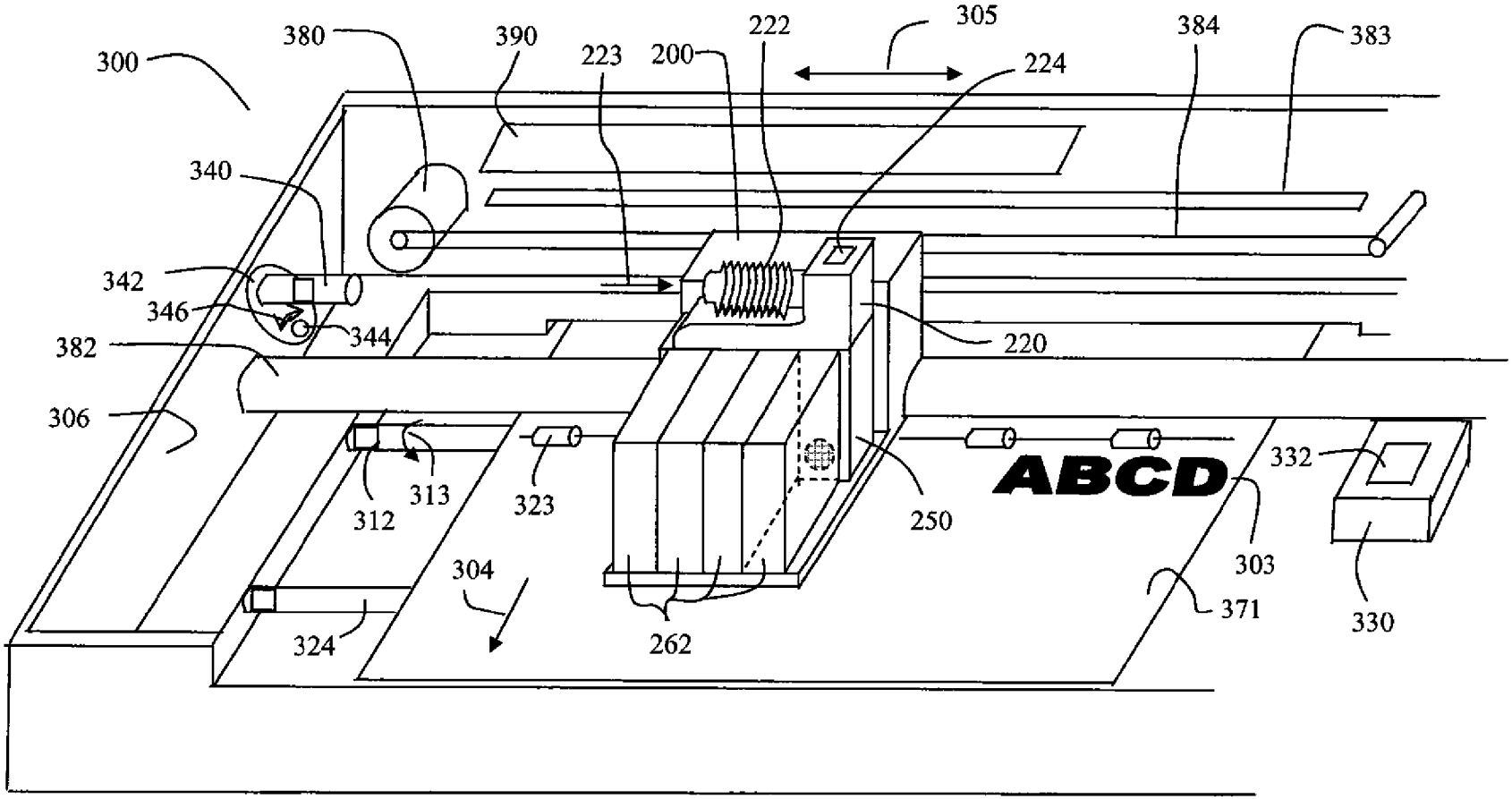
FIG. 2 is a schematic perspective view of a portion of a carriage printer according to an embodiment of the invention.

FIG. 2 shows a schematic perspective view of a portion of a desktop carriage printer according to an embodiment of the invention. Some of the parts of the printer have been hidden in the view shown in FIG. 2 so that other parts can be more clearly seen. Printer chassis 300 has a print region 303 across which carriage 200 is moved back and forth in carriage scan direction 305, while drops of ink are ejected from printhead 250 that is mounted on carriage 200. The letters ABCD indicate a portion of an image that has been printed in print region 303 on a piece 371 of paper or other recording medium. Carriage motor 380 moves belt 384 to move carriage 200 along carriage guide rod 382. An encoder sensor (not shown) is mounted on carriage 200 and indicates carriage location relative to an encoder 383.

Printhead 250 is mounted in carriage 200, and ink tanks 262 are mounted to supply ink to printhead 250, and contain inks such as cyan, magenta, yellow and black, or other recording fluids. Optionally, several ink tanks can be bundled together as one multi-chamber ink supply, for example, cyan, magenta and yellow. Inks from the different ink tanks 262 are provided to different nozzle arrays, as described in more detail below.

A variety of rollers are used to advance the recording medium through the printer. In the view of FIG. 2, feed roller 312 and passive roller(s) 323 advance piece 371 of recording medium along media advance direction 304, which is substantially perpendicular to carriage scan direction 305 across print region 303 in order to position the recording medium for the next swath of the image to be printed. Discharge roller 324 continues to advance piece 371 of recording medium toward an output region where the printed medium can be retrieved. Star wheels (not shown) hold piece 371 of recording medium against discharge roller 324.

Typical lengths of recording media are 6 inches for photographic prints (4 inches by 6 inches) or 11 inches for paper (8.5 by 11 inches). Thus, in order to print a full image, a number of swaths are successively printed while moving printhead chassis 250 across the piece 371 of recording medium. Following the printing of a swath, the recording medium 20 is advanced along media advance direction 304. Feed roller 312 can include a separate roller mounted on the feed roller shaft, or can include a thin high friction coating on the feed roller shaft. A rotary encoder (not shown) can be coaxially mounted on the feed roller shaft in order to monitor the angular rotation of the feed roller 312. The motor that powers the paper advance rollers, including feed roller 312 and discharge roller 324, is not shown in FIG. 2. For normal paper feeding feed roller 312 and discharge roller 324 are driven in forward rotation direction 313.

Toward the rear of the printer chassis 300, in this example, is located the electronics board 390, which includes cable connectors for communicating via cables (not shown) to the printhead carriage 200 and from there to the printhead 250. Also on the electronics board are typically mounted motor controllers for the carriage motor 380 and for the paper advance motor, a processor and/or other control electronics (shown schematically as controller 14 and image processing unit 15 in FIG. 1) for controlling the printing process, and an optional connector for a cable to a host computer.

Toward the right side of the printer chassis 300, in the example of FIG. 2, is the maintenance station 330. Maintenance station 330 can include a wiper (not shown) to clean the nozzle face of printhead 250, as well as a cap 332 to seal against the nozzle face in order to slow the evaporation of volatile components of the ink. Many conventional printers include a vacuum pump attached to the cap in order to suck ink and air out of the nozzles of printhead when they are malfunctioning.

A different way to remove air from the printhead 250 is shown in FIG. 2 and discussed in more detail below relative to embodiments of the present invention. Air extraction chamber 220 is attached to printhead 250. A compressible member such as a bellows 222 is part of air extraction chamber 220. As bellows 222 is compressed, it forces air out of the air extraction chamber 220 through one-way relief valve 224. Bellows 222 is configured such that it tends to expand by itself from a compressed state. As bellows 222 expands, it provides a reduced air pressure in the air extraction chamber 220, which extracts air from printhead 250 as discussed in more detail below. Bellows 222 is mounted so that it is compressible along a compression direction 223 substantially parallel to carriage scan direction 305. Bellows 222 is in line with a compressing member, such as a projection 340 extending, for example, from a wall 306 of printer chassis 300. In order to compress bellows 222, carriage 200 is moved toward wall 306 until projection 340 engages bellows 222. Because the position of carriage 200 is tracked relative to encoder 383, the amount of movement of carriage 200 toward wall 306 can be precisely controlled, thereby controlling the amount of compression of bellows 222 by projection 340 as the carriage moves toward wall 306. Carriage 200 can be controlled to move bellows 222 to a predetermined position relative to projection 340, such that carriage 200 is moved by a predetermined distance after the bellows 222 strikes projection 340. Controller 14 (see FIG. 1) can include instructions to determine when it should send a signal to carriage motor 380 to move carriage 200 toward wall 306 to engage projection 340 with bellows 222 for compression. After the desired amount of compression of bellows 222 has been achieved, controller 14 can send a signal to carriage motor 380 to move carriage 200 away from the wall 306. Bellows 222 can remain partially in compression for an extended period of time as it slowly expands, thereby continuing to provide a reduced air pressure in air extraction chamber 220.

Projection 340 is located near one end of the carriage scan path. In some embodiments, as in FIG. 2, maintenance station 330 is located at the opposite end of the carriage scan path along carriage scan direction 305. In order to decrease the required width of printer chassis 300 needed to accommodate projection 340, in some embodiments, as in FIG. 2, projection 340 is attached to a movable projection mount 342 that can allow projection 340 to be moved into and out of engageable alignment with bellows 222, so that the carriage 200 can be brought closer to wall 306 without projection 340 engaging bellows 222. In the embodiment shown in FIG. 2, projection mount 342 is eccentrically attached to wall 306 by shaft 344. Projection mount 342 can be rotated about shaft 344 back and forth as indicated by rotation direction arrow 346. When the projection mount 342 is in the position shown in FIG. 2, projection 340 is in alignment to engage bellows 222. When the projection mount 342 is rotated to the position shown in FIG. 3, projection 340 is out of alignment and will not engage bellows 222. Because rotation direction 346 is along the forward 313 and reverse directions of feed roller 312, it is straightforward to rotate projection mount 340 using the same motor used to advance to feed roller 312, using an selectively connectable linkage such as a gear train or belt (not shown). US Patent Application Publication 20090174733, incorporated herein by reference in its entirety, discloses an apparatus and method of driving multiple printer functions using the same motor, which could be used to selectively disengage power from the feed roller 312 and use that motor to move the projection 340 in and out of the path of the bellows 222 as needed. Controller 14 (see FIG. 1) can include instructions regarding when it should send a signal to move the projection 340 into or out of engageable alignment with bellows 222.

Instructions for controller 14 to move carriage 200 and/or to move projection 340 such that bellows 222 strikes projection 340 and is compressed can be event-based, clock-based, count-based, sensor-based or a combination of these. Examples of an event-based instruction would be for controller 14 to send appropriate signals to cause bellows 222 to be compressed when the printer is turned on, or just before or after a maintenance operation (such as wiping) is performed, or after the last page of a print job is printed. An example of a clock-based instruction would be for the controller to send appropriate signals to cause bellows 222 to be compressed one hour after the last time the bellows 222 were compressed. Examples of a count-based instruction would be for controller 14 to send appropriate signals to cause bellows 222 to be compressed after a predetermined number of pages were printed, or after a predetermined number of maintenance cycles were performed. Examples of a sensor-based instruction would be for controller 14 to send appropriate signals to cause bellows 222 to be compressed when an optical sensor detects that one or more jets are malfunctioning, or when a thermal sensor indicates that the printhead has exceeded a predetermined temperature. An example of a combination-based instruction would be for controller to send appropriate signals to cause bellows 222 to be compressed when a thermal sensor and a clock indicate that the printhead has been above a predetermined temperature for longer than a predetermined length of time. Instructions from controller 14 can be either to cause full compression or no compression of bellows 222, or alternatively can cause bellows 222 to be compressed by one of a plurality of predetermined amounts, by moving carriage 200 by corresponding amounts, as monitored relative to encoder 383.

Because air that is dissolved in the ink tends to exsolve, that is to come out of solution when the ink is raised to elevated temperatures, in some embodiments the method of extracting air from the printhead can include heating a portion of the printhead in conjunction with applying reduced air pressure via the air extraction chamber. This is particularly straightforward for a thermal inkjet printhead including a printhead die having drop ejectors that include heaters to vaporize ink in order to eject droplets of ink from the nozzles. Electrical pulses to heat the heaters can be of sufficient amplitude and duration that they cause drops to be ejected, or electrical pulses can be below a drop firing threshold. In various embodiments, controller 14 can cause firing pulses or nonfiring pulses to heat the printhead die 251 before or during the time when bellows 222 is allowed to expand and thereby provide reduced pressure at air extraction chamber 220 in order to draw exsolved air out of the printhead 250.

Figure 4B:
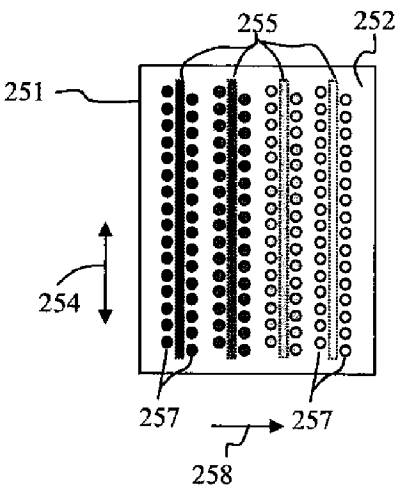
FIG. 4B is a nozzle face view of a printhead die that can be used in the printhead of FIG. 4A.
Figure 4A:
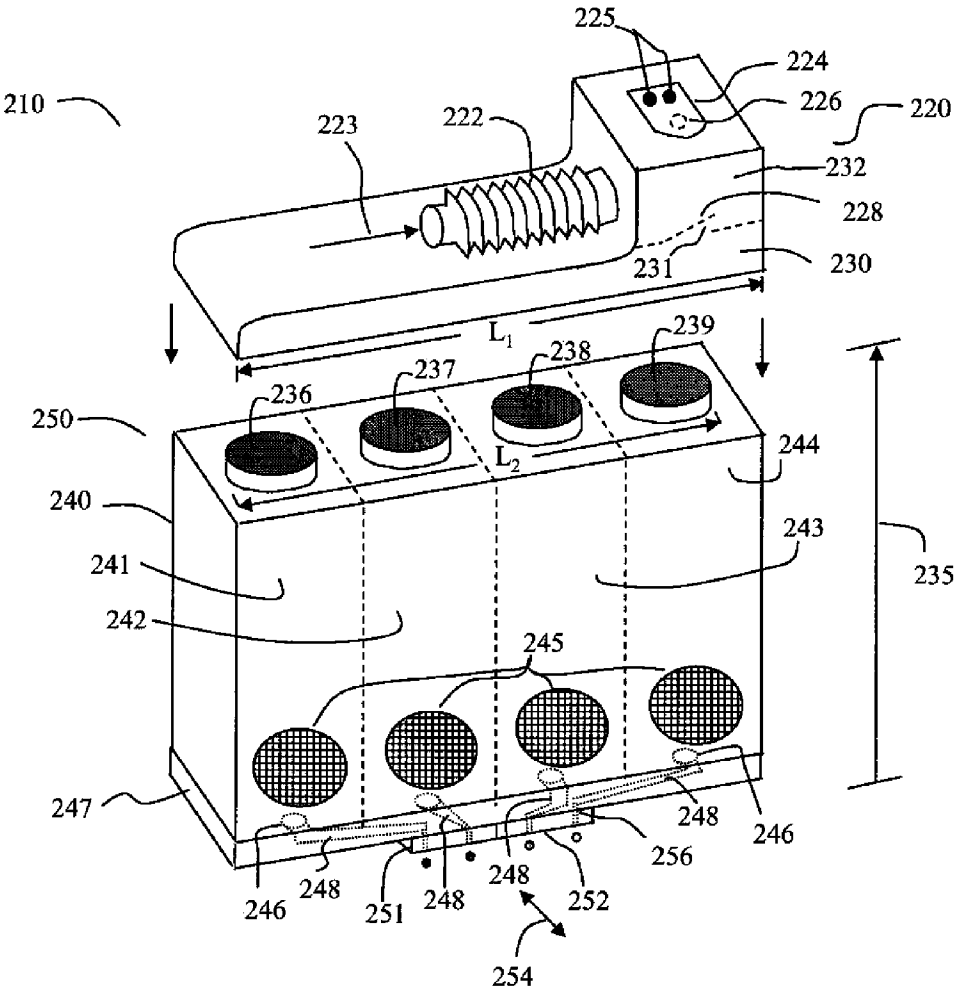
FIG. 4A is a perspective exploded front view of a printhead assembly including a printhead with an air extraction chamber according to an embodiment of the invention.

Printhead 250 and air extraction chamber 220 are shown in more detail in FIG. 4A. The term printhead assembly 210, when used herein, will include printhead 250 and its component parts, as well as air extraction chamber 220 and its component parts. The downward arrows below air extraction chamber 220 indicate how it assembles together with printhead 250. Additional parts of air extraction chamber 220 shown in FIG. 4A include a one-way containment valve 228 separating air extraction chamber 220 into an air accumulation chamber 230 and an air expulsion chamber 232. In addition, an example of a flapper valve as one-way relief valve 224 is shown. Fastener(s) 225 connect the flapper valve to an outer surface of air extraction chamber 220. The flapper valve typically is made of an elastomeric sheet, which in its normal state covers and seals air vent 226 in the air expulsion chamber 232. Likewise, one-way containment valve 228 can also be a flapper valve that seals and covers air passage 231. Normally, one-way relief valve 224 and one-way containment valve 228 are both closed. When the pressure in air expulsion chamber 232 is greater than ambient pressure by a sufficient amount to force one-way relief valve 224 to an open position, a quantity of air is expelled from air expulsion chamber 232 through one-way relief valve 224. Then elastomeric restoring forces close the one-way relief valve 224 again, so that air can no longer be vented through air vent 226. Similarly, when the pressure in air accumulation chamber 230 is greater than the pressure in air expulsion chamber 232 by a sufficient amount to force one-way containment valve 228 open, air is transferred from air accumulation chamber 230 to air expulsion chamber 232 through air passage 231. Then elastomeric restoring forces close the one-way containment valve 228 again.

Printhead 250 includes a printhead body 240 having a plurality of ink chambers. In the example shown in FIG. 4A, ink chambers 241, 242, 243 and 244 contain black, cyan, magenta, and yellow ink respectively. Other embodiments can have more than four ink chambers or fewer than four ink chambers. Ink enters the ink chambers 241-244 by their respective inlet ports 245, which optionally can be covered by filters in order to keep contaminants such as particulate debris out of the ink chambers. At the top of each ink chamber 241, 242, 243 and 244 is a corresponding membrane 236, 237, 238 and 239 respectively. Membranes 236-239 are permeable to air but not permeable to liquid. In other words, air can pass through membranes 236-239, but ink cannot pass through.

Ink exits ink chambers 241-244 through respective ink outlets 246 in order to provide ink to printhead die 251. Printhead die 251 contain nozzle arrays 257 (FIG. 4B) on nozzle face 252, with different nozzle arrays being supplied with ink from different ink chambers 241-244. In FIG. 4A there are two printhead die 251, each containing two nozzle arrays. In FIG. 4B, all four nozzle arrays 257 are alternatively shown on one printhead die 251. Nozzle arrays 257 are disposed along an array direction 254, with arrays being separated from each other along an array separation direction 258. Typically, in order to reduce cost of the printhead die 251, it is desired to keep the total width along the array separation direction 258 relatively small compared to the width of the printhead body 240 along that direction. In some embodiments, as in FIG. 4A, a manifold 247 is used to bring ink from the ink outlets 246 of each ink chamber 241-244 to the corresponding ink inlets 256 on the side of printhead die 251 that is opposite the nozzle face 252. Ink flows from the ink inlets 256 to the corresponding ink feeds 255 (FIG. 4B) and from there to the respective nozzle arrays 257. The small circles below printhead die 251 in FIG. 4A represent droplets of different color inks ejected from the different nozzle arrays 257. For inner ink chambers 242 and 243, which are located substantially vertically above printhead die 251 in the example of FIG. 4A, the corresponding manifold passageways 248 from printhead die 251 to printhead ink outlets 246 can be substantially vertical. For the outer ink chambers 241 and 244, the corresponding manifold passageways 248 can have more extensive horizontal or slightly inclined portions. Printhead die 251 can be mounted on a mounting substrate in some embodiments that is located between the printhead die 251 and the manifold 247. In some embodiments, such as shown in FIG. 4A, the manifold 247 is the mounting substrate.

A method of air extraction from printhead 250 can be described with reference to FIG. 2 and FIG. 4A. Carriage 200 is moved toward wall 306 along carriage scan direction 305 until bellows 222 is compressed by projection 340 along compression direction 223, which is parallel to carriage scan direction 305. Air that had been in bellows 222 is forced into air expulsion chamber 232, thereby raising the pressure in that chamber such that normally closed one-way relief valve 224 is forced open and a quantity of air is expelled. Then one-way relief valve 224 closes again. After carriage 200 moves away from wall 306, bellows 222 can expand. As bellows 222 expands, the total volume in bellows 222 and air expulsion chamber 232 increases. Since pressure is inversely proportional to volume of a gas, the pressure in air expulsion chamber 232 decreases as bellows 222 expands. When the pressure in air expulsion chamber 232 becomes sufficiently less than the pressure in air accumulation chamber 230 that one-way containment valve 228 is forced open, some air passes from air accumulation chamber 230 to air expulsion chamber 232 through air passage 231. This reduces the pressure in air accumulation chamber 230 (while tending to raise the pressure in air expulsion chamber 232) until one-way containment valve 228 closes, and the air passage 231 is sealed again so that no more air can pass between air accumulation chamber 230 and air expulsion chamber 232. The reduced air pressure in air accumulation chamber 230 is applied to membranes 236-239. In other words, the pressure in air accumulation chamber 230 is lower than the pressure in ink chambers 241-244. As a result, air is drawn from ink chambers 241-244 through membranes 236-239, thus extracting air from ink chambers 241-244 of printhead 250. As bellows 222 continues to expand and air continues to be drawn from ink chambers 241-244 into air accumulation chamber 230, the pressure in air accumulation chamber 230 can again exceed that in air expulsion chamber 232 sufficiently to force one-way containment valve 228 open, thereby bringing the pressure in air accumulation chamber 230 to a reduced level again. When the carriage 200 is moved toward wall 306 again to engage projection 340 to compress bellows 222, air that has been transferred to air expulsion chamber 232 and bellows 222 from air accumulation chamber 230 is expelled through one-way relief valve 224. Typically, during compression of bellows 222, the one-way containment valve 228 is in its normally closed position. However, if one-way containment valve 228 happens to be open when bellows 222 begins to be compressed, increased pressure in air expulsion chamber 232 will cause one-way containment valve 228 to close, so that pressure further builds up in air expulsion chamber 232, forcing air out air vent 226.

Some preferred geometrical details are also shown in FIG. 4A. The air accumulation chamber 230 of air extraction chamber 220 has a length dimension L1 along compression direction 223. The distance L2 from an outermost edge of a first membrane (such as membrane 236) to an opposite outermost edge of a second membrane (such as membrane 239) is preferably less than L1. In that way, a single air extraction chamber 220 can draw air from a plurality of ink chambers through a corresponding plurality of membranes. In FIG. 4A, one air extraction chamber 220 is able to provide air management for four ink chambers 241-244, since the air accumulation chamber 230 is able to provide a reduced pressure to the corresponding four membranes 236-239.

Nozzle arrays 257 are disposed along nozzle array direction 254 that is substantially parallel to media advance direction 304. Nozzle array separation direction 258 is substantially parallel to carriage scan direction 305. In order to simplify connection of inks from ink chamber ink outlets 246 to printhead die ink inlets 256, therefore, ink chambers 241-244 are preferably displaced from one another along carriage scan direction 305. Since compression direction 223 of bellows 222 is also substantially parallel to carriage scan direction 305, ink chambers 241-244 are preferably displaced from each other along a direction that is substantially parallel to compression direction 223. Also, since carriage scan direction 305 is substantially perpendicular to media advance direction 304, it follows that compression direction 223 is substantially perpendicular to array direction 254. Furthermore, with reference to FIG. 2, the plane of print zone 303 of printer chassis 300 is substantially parallel to both carriage scan direction 305 and media advance direction 304. When printhead 250 is mounted in printhead chassis 300, membranes 236-239 are preferably substantially vertically above ink outlets 248, printhead die ink inlets 256 and inlet ports 245 in order to facilitate air bubbles rising through the ink, as described below. In other words, it is preferred that membranes 236-239 be displaced from nozzle arrays 257 (i.e. from the arrays of drop ejectors) along a membrane displacement direction 235 that is substantially perpendicular to both array direction 254 and compression direction 223.

Figure 3:
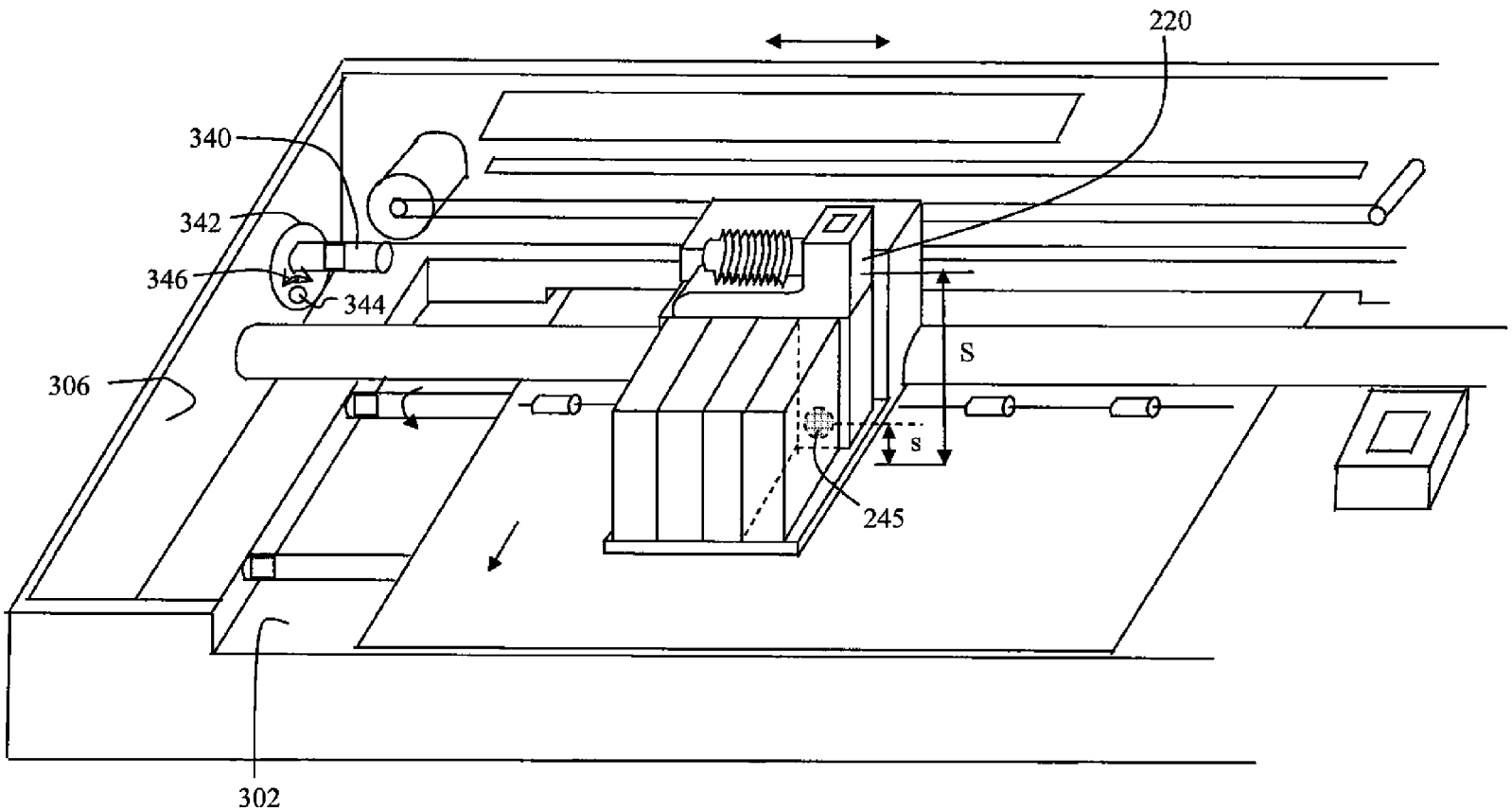
FIG. 3 is a schematic perspective view similar to FIG. 2, with a projection rotated out of engagement alignment.
Figure 5B:
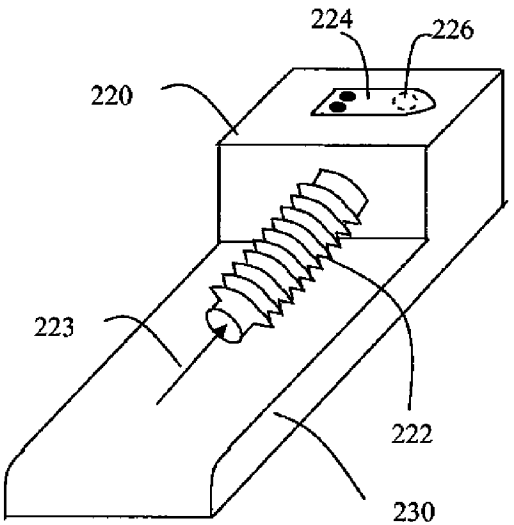
FIG. 5B is a perspective side view of the air extraction chamber of FIG. 4A.
Figure 5A:
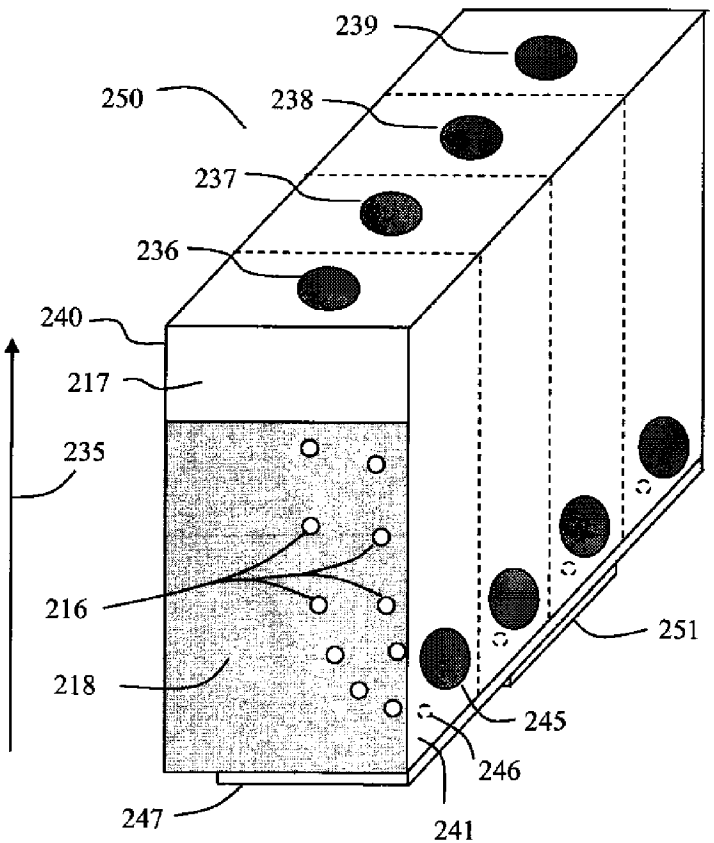
FIG. 5A is a perspective side view of a printhead similar to that of FIG. 4A.

FIG. 5A shows a perspective view of a printhead 250 similar to that of FIG. 4A, but rotated about an axis parallel to membrane displacement direction 235. FIG. 5B is similarly rotated view of air extraction chamber 220. The view of FIG. 5A looks through a side wall of ink chamber 241 and shows air bubbles 216 rising through liquid ink 218 in a direction substantially parallel to membrane displacement direction 235. Air bubbles 216 rise both from ink outlets 246 and from inlet ports 245 of printhead 250. Air bubbles 216 originating at ink outlet 246 can come, for example, from printhead die 251 due to air that is exsolved from the ink 218 at elevated temperatures. Air bubbles 216 originating at inlet ports 245 can enter, for example, during the changing of ink tanks 262 (see FIG. 2). Air extraction chamber 220 is effective in extracting bubbles from both sources. The open vertical geometry of ink chamber 241, leading to an air space 217 above liquid ink 218 and from the air space 217 to membrane 236, facilitates the free rising of air bubbles 216 through liquid ink 218, due to their buoyancy, toward the air space 217 and membrane 236. Another way of describing such a vertical geometry, with reference also to FIG. 3, is that a distance S between the inlet port 245 of the ink chamber 241 and the support base 302 of printer chassis 300 is less than a distance S between air extraction chamber 220 and support base 302. Similarly, a distance between the ink outlet 246 of ink chamber 241 and the support base 302 of printer chassis 300 is less than the distance S between air extraction chamber 220 and support base 302 (although the ink outlet 246 is not shown in FIG. 3 for clarity).

Figure 6B:
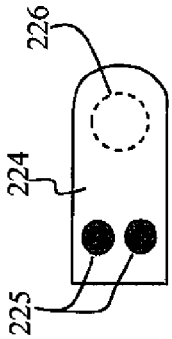
FIG. 6B is an example of a one-way valve that can be used in the invention.
Figure 6A:
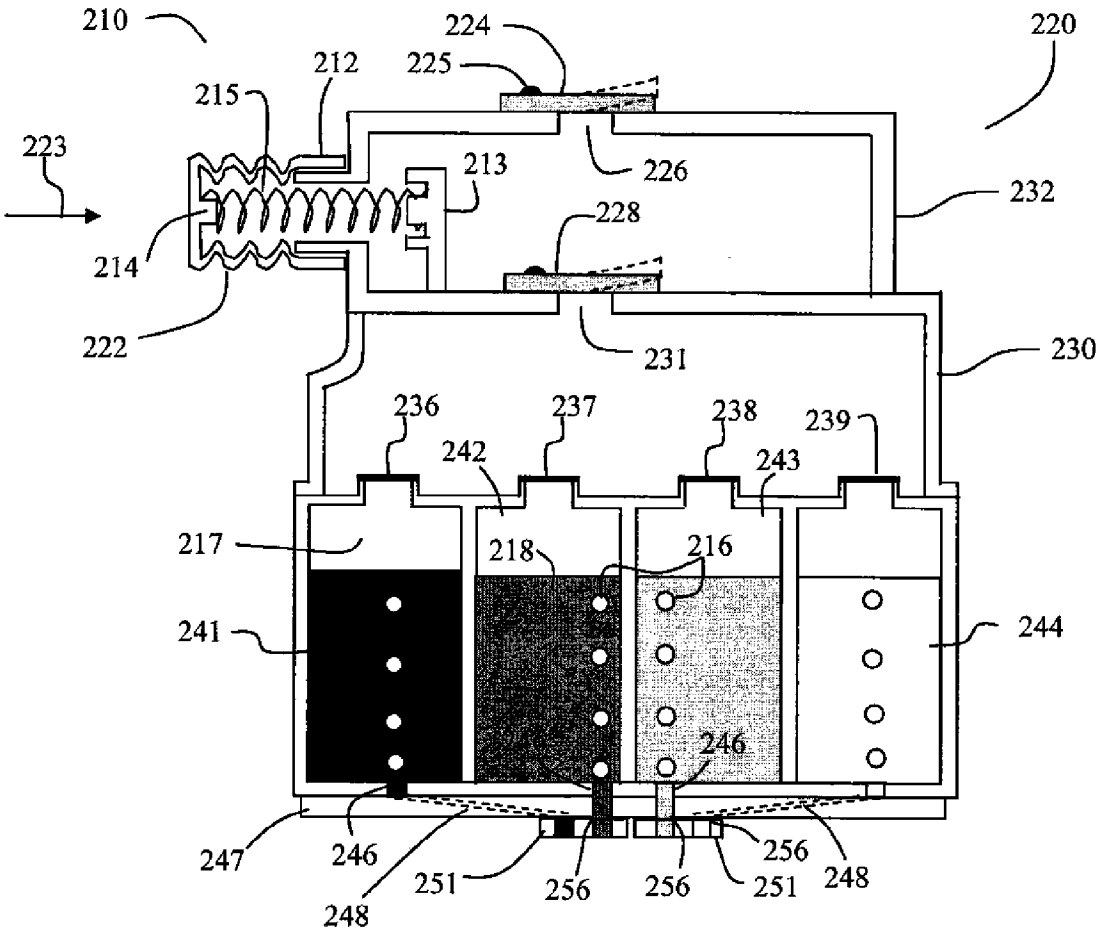
FIG. 6A is cross-sectional view of a printhead assembly according to an embodiment of the invention.

FIG. 6A is a cross-sectional view of a printhead assembly 210 according to an embodiment of the invention. In this embodiment, a compression spring 215 is held between a fixed support 213 within air expulsion chamber 232 and a movable support 214 near the end of bellows 222. Compression spring 215 helps bellows 222 to expand after bellows 222 has been compressed along compression direction 223. In some other embodiments, bellows 222 is made of materials having sufficient elastic properties to provide the expansion forces needed for bellows expansion without use of a compression spring. Providing compression spring 215 within bellows 222 can allow the use of cheaper or otherwise more optimal materials for making bellows 222. The non-moving end 212 of bellows 222 is affixed to air expulsion chamber 232, such that air is freely flowable between the interior of bellows 222 and the interior of air expulsion chamber 232.

FIG. 6A illustrates the open positions and the closed positions of both one-way relief valve 224 and one-way containment valve 228 for the case where both are flapper valves of the type shown in FIG. 6B. The normally closed position of one-way relief valve 224 against air vent 226 is shown by the gray-shaded solid line rectangle. The open position away from air vent 226 is shown by the dashed lines. Similarly, the normally closed position of one-way containment valve 228 against air passage 231 is shown by the gray-shaded solid line rectangle, while the open position away from air passage 231 is shown by the dashed lines.

It is not required that the seals in air extraction chamber 220 be airtight. Including the effects of air entering air extraction chamber 220 from ink chambers 241-244 through membranes 236-239, and leaks at various seals, the time constant for loss of pressure differential between ambient pressure and pressure in air extraction chamber 220 can be between about 5 seconds and about one hour in some embodiments.

FIG. 6A shows air bubbles 216 rising freely from ink outlets 246 in ink chambers 241-244 through liquid ink 218 toward air space 217 above liquid ink 218. For inner ink chambers 242 and 243, the entire ink pathway from printhead die ink inlets 256, through manifold 247 to ink inlets 246 to air space 217 to air extraction chamber 220 is substantially vertical and this is preferred for movement of air bubbles 216. In order to reduce the costs of printhead die 251 and in order to provide sufficient ink in ink chambers 241-244, it will generally be true that the distance between outermost ink inlets 256 will be somewhat less than the distance between outermost ink chambers 241 and 244, so that for embodiments such as that shown in FIG. 6A, the outer manifold passageways 248 will have a portion with a slight incline from horizontal.

Figure 7B:
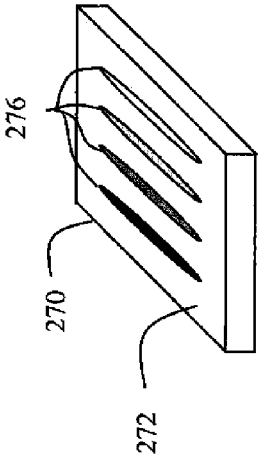
FIG. 7B is a perspective view of a side of the mounting substrate of FIG. 6A having outlet openings for connection to the printhead die.
Figure 7A:
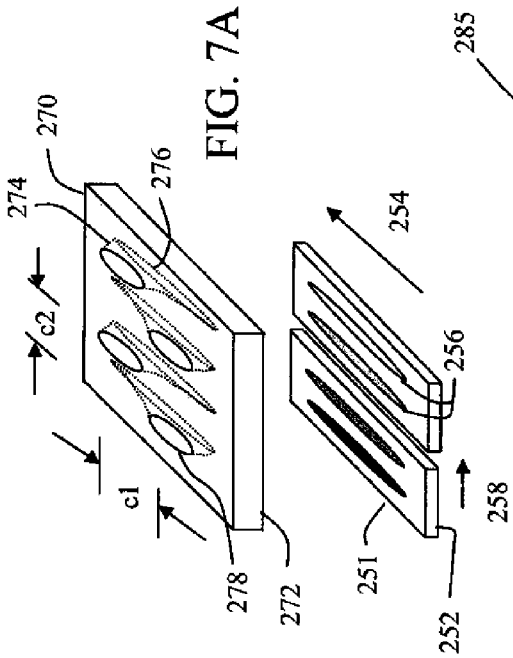
FIG. 7A is an exploded perspective view of a mounting substrate and two printhead die according to an embodiment of the invention.
Figure 7C:
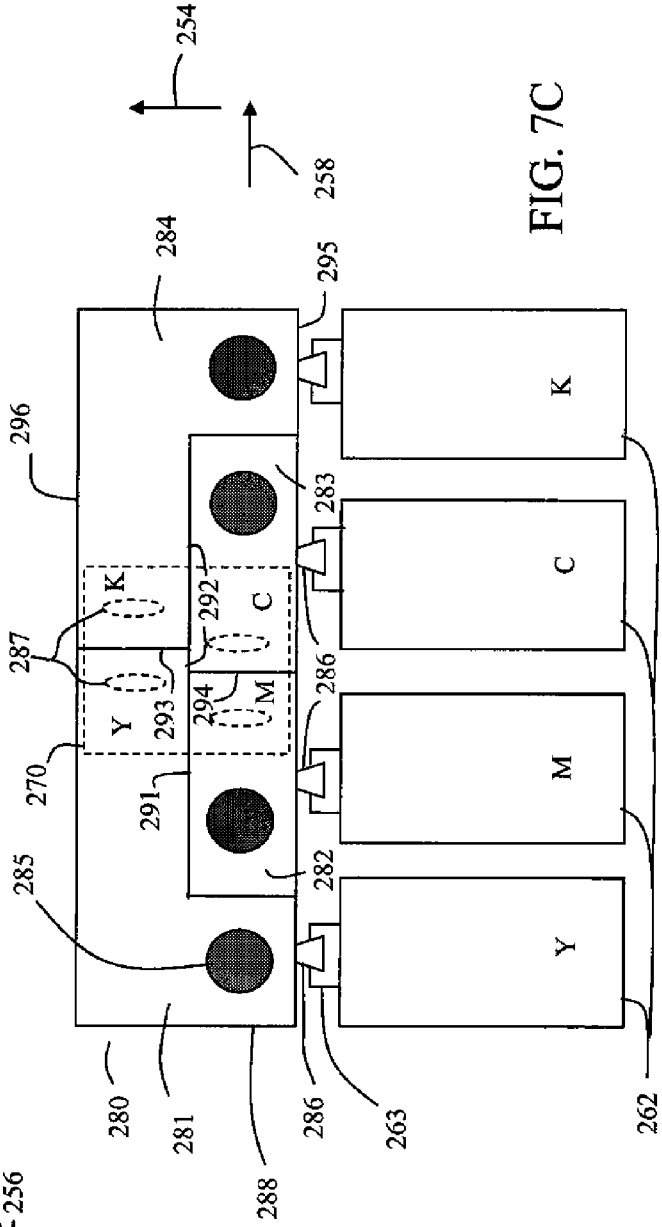
FIG. 7C is schematic top view of a portion of a printhead and ink tanks according to an embodiment of the invention.

In other embodiments, a wrap-around ink chamber geometry illustrated in FIG. 7C can be used in order to provide a more vertical pathway in the printhead for air bubble flow all the way from the printhead die 251 to the air space 217 above the liquid ink 218, even for the outside ink chambers. The wrap-around ink chamber geometry is particularly compatible with printhead die configurations, as shown in the exploded view of FIG. 7A, where the ink inlets 256 are longer along nozzle array direction 254 than the spacing between ink inlets 256 along the array separation direction 258. Two trends make this printhead die configuration more advantageous. Printing speed is increased by providing a longer print swath, i.e. a longer nozzle array length. Printhead die cost is decreased by shrinking the area of the die. Therefore, to provide a low cost, high speed printhead, it is advantageous to have the nozzle arrays longer than the spacing between nozzle arrays. In the embodiment shown in FIG. 7A, there are two printhead die 251, each having two nozzle arrays on nozzle face 252, and corresponding ink inlets 256 on the face opposite nozzle face 252. The ink inlet faces of printhead die 251 are sealingly affixed to the die bonding face 272 of mounting substrate 270, typically with an ink-compatible die bonding adhesive to provide fluid connection. Mounting substrate 270 includes mounting substrate passages 274 for providing ink from the ink chambers of the printhead to the printhead die. In the embodiment shown in FIG. 7A, mounting substrate passages 274 are shoe-shaped. On the die bonding face 272 of mounting substrate 270, the mounting substrate passages 274 exit as elongated outlet openings 276 (see FIG. 7B), suitable for mating to similarly shaped ink inlets 256 of printhead die 251. On the printhead mounting face 275 of mounting substrate 270, mounting substrate passages 274 exit as smaller inlet openings 278 that are alternately staggered from one another along a direction nozzle array direction 254. In other words, the displacement between two adjacent inlet openings 278 has a component c1 that is parallel to array direction 254, and a component c2 that is parallel to array separation direction. In many embodiments, c1 is greater than c2. To provide the staggered configuration of inlet openings 278 in the embodiment shown in FIG. 7A, adjacent shoe-shaped mounting substrate passages 274 are oriented oppositely to one another. Elongated outlet openings 276 are fluidly connected to smaller inlet openings 278 by the portions of mounting substrate passages 274 that are internal to the mounting substrate 270.

The wrap-around ink chamber geometry of printhead 280 is illustrated in the top view shown in FIG. 7C. Printhead body 288 includes a plurality of ink chambers 281-284 and a linear arrangement of inlet ports 286 for ink chambers 281-284. Printhead body 288 includes a first outer wall 295 and a second outer wall 296 opposite the first outer wall 295. First outer wall 295 is located proximate (i.e. at or near) the inlet ports 286, while second outer wall 296 is distal to the inlet ports 286. In this embodiment, the outer ink chambers 281 and 284 are L-shaped and wrap around the inner ink chambers 282 and 283. As a result, outer ink chambers 281 and 284 each have a first portion located near first outer wall 295 and second portion located near second outer wall 296. Inner ink chambers 282 and 283 each have a portion located near first outer wall 295, but no portion located near second outer wall 296. Each ink chamber has an air permeable membrane 285 that is not permeable to liquid, an inlet port 286, and an ink outlet 287. Ink outlets 287 are arranged on a bottom face of ink chambers 281-284 in the same staggered configuration as the smaller inlet openings 278 on printhead mounting face of mounting substrate 270. Each ink outlet 287 of the ink chambers 281-284 can be fluidly connected to a corresponding inlet opening 278 on mounting substrate 270, for example with a gasket seal. Ink chambers 281-284 contain liquid ink and have an air space at the top of the ink chamber above the liquid ink, similar to the relationship of liquid ink 218 and air space 217 that is shown in FIGS. 5A and 6A. Because there is a substantially vertical travel pathway for air bubbles to the air space from the mounting substrate inlet openings 278 and corresponding ink outlets 287 of ink chambers 281-284 (for outer ink chambers 281 and 284 as well as inner ink chambers 282 and 283), air bubble movement to the air space is not impeded. In fact, the vertical travel pathway extends to ink inlets 256 of printhead die 251, where the ink inlets 256 correspond to nozzle arrays 257 (see FIG. 4B). In addition, because there is a substantially vertical travel pathway for air bubbles to the air space from the inlet ports 286, air bubble movement from the inlet ports 286 to the air space at the top of the corresponding ink chambers is also not impeded. The position of membranes 285 within ink chambers 281-284 is not critical, as long as membranes 285 are in contact with the air space of the corresponding ink chamber, and as long as the membranes can fit within the air extraction chamber dimensions.

In the embodiment shown in FIG. 7C, ink chamber 281 has an inlet port 286 that is adjacent to the inlet port 286 of ink chamber 282. Because of the staggered configuration of ink outlets 287, and the wrap-around ink chamber geometry of printhead 280, the ink outlet 287 of ink chamber 281 is displaced from the ink outlet 287 of ink chamber 282, such that the displacement between the two outlets 287 has a component c1 that is parallel to the nozzle array direction 254 and a component c2 that is parallel to the array separation direction 258 (see also FIG. 7A). Other implications of the wrap-around ink chamber geometry have to do with the configuration of inner walls shared between ink chambers. In the discussion that follows, the numbering convention for the ink chambers 281, 282, 283 and 284 (i.e. first, second, third and fourth respectively) is based on the position of the corresponding inlet ports for those ink chambers. The inlet port 286 of the second ink chamber 282 (the first inner chamber) is between the inlet port 286 of the first ink chamber 281 (the first outer chamber) and the inlet port 286 of the third ink chamber 283 (the second inner chamber). Similarly, the inlet port 286 of the third ink chamber 283 (the second inner chamber) is between the inlet port 286 of the second ink chamber 282 (the first inner chamber) and the inlet port 286 of the fourth ink chamber 284 (the second outer chamber). Wall 291 is shared between first ink chamber 281 and second ink chamber 282. After wall 291 intersects wall 294 that is shared between second ink chamber 282 and third ink chamber 283, wall 291 further extends to a wall 292 that is shared between the first ink chamber 281, the second ink chamber 282 and the third ink chamber 283. Wall 292 is also shared between the third ink chamber 283 and the fourth ink chamber 284. Wall 293, which intersects second outer wall 296, is shared between the first ink chamber 281 and fourth ink chamber 284. Wall 293 is substantially perpendicular to wall 292.

In the embodiment shown in FIG. 7C, tank ports 263 of dismountable ink tanks 262 are fluidly connected to respective inlet ports 286 of ink chambers 281-284. From left to right along the array separation direction 258 in FIG. 7C, the order of the different color inks supplied to inlet ports 286 of ink chambers 281-284 is YMCK (yellow, then magenta, then cyan, and then black). A consequence of the wrap-around ink chamber geometry of printhead 280, is that the ink outlets 287 of ink chambers 281-284 are arranged in a different order MYCK along array separation direction 258.

Figure 8:
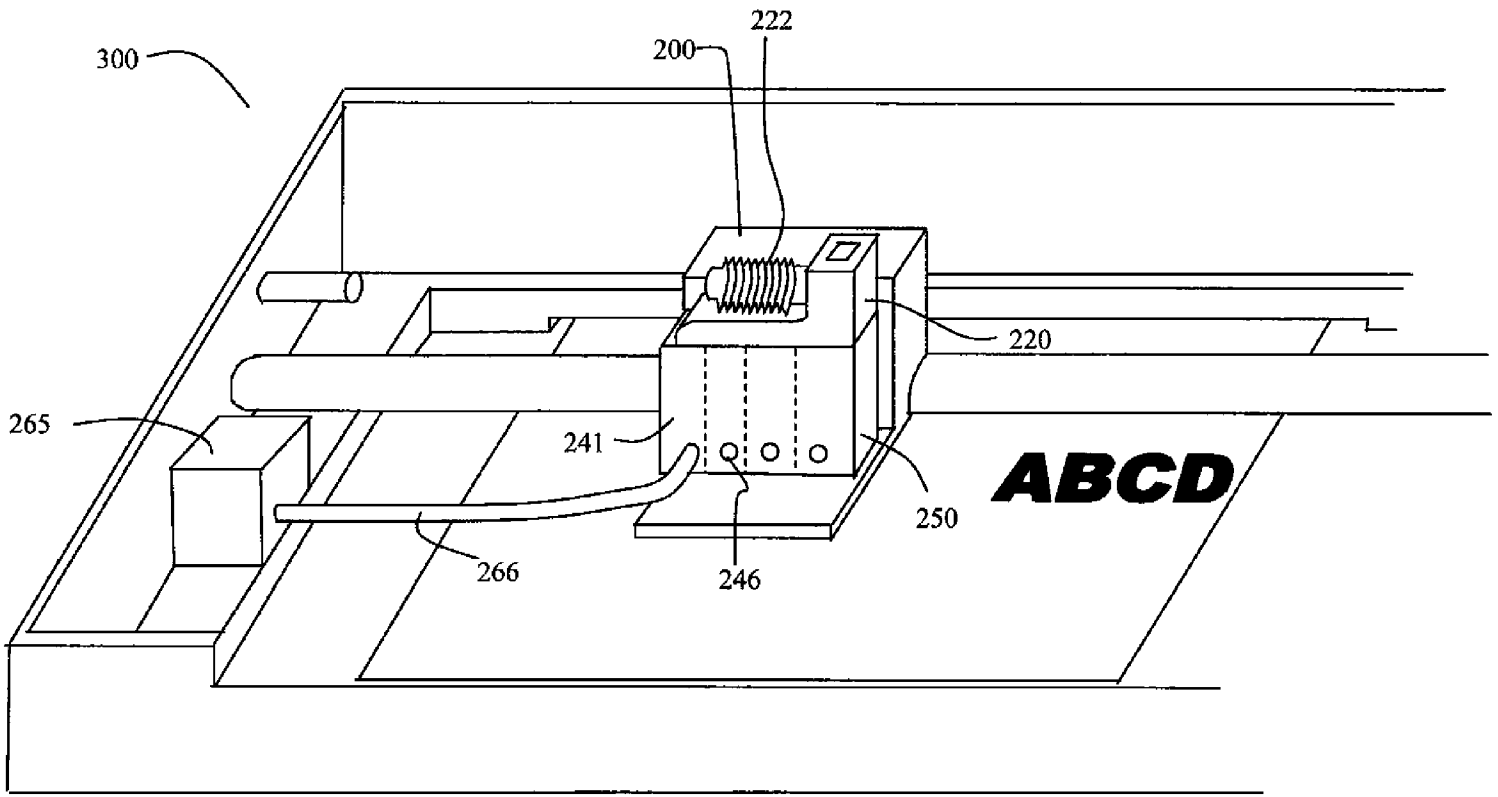
FIG. 8 is a schematic perspective view of a portion of a carriage printer according to an embodiment of the invention.

FIG. 8 shows an embodiment of the present invention where ink is supplied to the ink chamber 241 of printhead 250 from a remote ink supply 265 that is mounted stationary on printhead chassis 300, rather than from ink tanks that are mounted on movable carriage 200. Ink is supplied to ink chamber 241 through flexible tubing 266 which is connected to inlet port 246. For clarity, flexible tubing 266 is shown connected only to one of the four inlet ports in FIG. 8. Air extraction chamber 220 operates in a similar fashion as described above relative to other embodiments.

Figure 9:
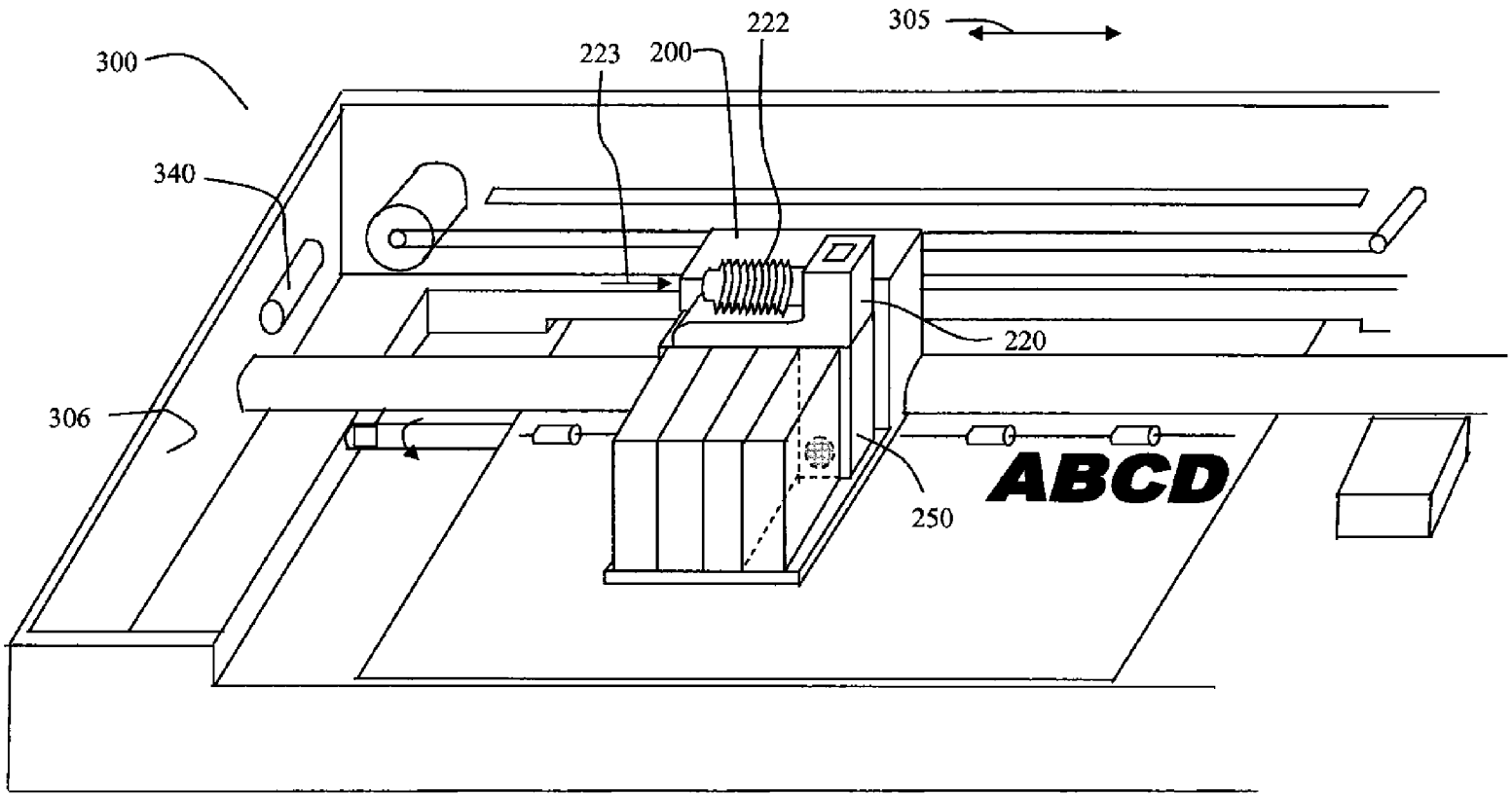
FIG. 9 is a schematic perspective view of a portion of a carriage printer according to an embodiment of the invention.

FIG. 9 shows an embodiment that moves projection 340 into and out of engageable alignment with bellows 222 in a different fashion than described above relative to FIGS. 2 and 3. In the embodiment of FIG. 9, projection 340 is pivotably mounted to wall 306. When it is desired to compress bellows 222 along compression direction 223, projection 340 is oriented extending outwardly from wall 306 along a direction substantially parallel to carriage scan direction 305 as in FIG. 2. When it is desired to move projection 340 out of alignment with bellows 222, it is pivoted against wall 306 as shown in FIG. 9, so that projection 340 is in an orientation that is not substantially parallel to carriage scan direction 305.

Because embodiments of this invention extract air without extracting ink, less ink is wasted than in conventional printers. The waste ink pad used in conventional printers can be eliminated, or at least reduced in size to accommodate maintenance operations such as spitting from the jets. This allows the printer to be more economical to operate, more environmentally friendly and more compact. Furthermore, since the air extraction method of the present invention can be done at any time, with the reduced pressure from the air extraction chamber applied to the printhead over a continuous time interval, it is not necessary to delay printing operations to extract air from the printhead.

The invention has been described in detail with particular reference to certain preferred embodiments thereof, but it will be understood that variations and modifications can be effected within the spirit and scope of the invention.

PARTS LIST

10 Inkjet printer system
12 Image data source
14 Controller
15 Image processing unit
16 Electrical pulse source
18 First fluid source
19 Second fluid source
20 Recording medium
100 Inkjet printhead
110 Inkjet printhead die
111 Substrate
120 First nozzle array
121 Nozzle(s)
122 Ink delivery pathway (for first nozzle array)
130 Second nozzle array
131 Nozzle(s)
132 Ink delivery pathway (for second nozzle array)
181 Droplet(s) (ejected from first nozzle array)
182 Droplet(s) (ejected from second nozzle array)
200 Carriage
210 Printhead assembly
212 Non-moving end
213 Fixed support
214 Movable support
215 Compression spring
216 Air bubbles
217 Air space
218 Liquid ink
220 Air extraction chamber
222 Bellows
223 Compression direction
224 One-way relief valve
225 Fastener(s)
226 Air vent
228 One-way containment valve
230 Air accumulation chamber
231 Air passage
232 Air expulsion chamber
235 Membrane displacement direction
236 Membrane
237 Membrane
238 Membrane
239 Membrane
240 Printhead body
241 Ink chamber
242 Ink chamber
243 Ink chamber
244 Ink chamber
245 Inlet port(s)
246 Ink outlet
247 Manifold
248 Manifold passageway(s)
250 Printhead
251 Printhead die
252 Nozzle face
253 Nozzle array
254 Nozzle array direction
255 Ink feed
256 Ink inlet
257 Nozzle array(s)
258 Array separation direction
262 Ink tank
265 Remote ink supply
266 Flexible tubing
270 Mounting substrate
272 Die bonding face
274 Mounting substrate passageway
275 Printhead mounting face
276 Outlet opening

278 Inlet opening
280 Printhead
281 Ink chamber
282 Ink chamber
283 Ink chamber
284 Ink chamber
285 Membrane
286 Inlet port
287 Ink outlet
288 Printhead body
291 Wall
292 Wall
293 Wall
295 First outer wall
296 Second outer wall
285 Second outer wall
300 Printer chassis
302 Support base
303 Print region
304 Media advance direction
305 Carriage scan direction
306 Wall
312 Feed roller
313 Forward rotation direction (of feed roller)
323 Passive roller(s)
324 Discharge roller
330 Maintenance station
332 Cap
340 Projection
342 Projection mount
344 Shaft
346 Rotation direction
371 Piece of recording medium
380 Carriage motor
382 Carriage guide rod
383 Encoder
384 Belt
390 Electronics board

The invention claimed is:

1. An inkjet printhead assembly comprising:

a) an array of nozzles with a corresponding ink inlet;

b) an ink chamber including an ink outlet that is fluidly connected to the ink inlet corresponding to the array of nozzles;

c) a membrane that is permeable to air but is not permeable to liquid, the membrane provided on the ink chamber; and d) an air extraction chamber coupled to the ink chamber comprising:

i) an air chamber;

ii) a one-way relief valve having an open position that allows venting of the air chamber to ambient and a closed position that does not allow venting of the air chamber to ambient; and iii) a compressible member having a compressed state which, when in the compressed state, forces air into the air chamber thereby causing air to be vented from the air chamber through the one-way relief valve in its open position, and for applying a reduced air pressure to the membrane while the one-way relief valve is in its closed position.

2. The inkjet printhead assembly of claim 1, the air extraction chamber further comprising:

a) an air expulsion portion of the air chamber disposed proximate the one-way relief valve;

b) an air accumulation portion of the air chamber; and c) a one-way containment valve between the air accumulation portion and the air expulsion portion, the one-way containment valve having an open position that allows air to pass between the air accumulation portion and the air expulsion portion, and a closed position that does not allow air to pass between the air accumulation portion and the air expulsion portion.

3. The inkjet printhead assembly of claim 2, wherein the one-way containment valve is movable to its open position by expansion of the compressible member.

4. The inkjet printhead assembly of claim 1 further comprising a dismountable ink tank including a port, wherein the ink chamber further comprises an inlet port that is fluidly connectable to the port of the dismountable ink tank.

5. The inkjet printhead assembly of claim 1 further comprising an ink supply that is remote from the ink chamber, wherein the ink chamber comprises an inlet port that is fluidly connectable to the to the remote ink supply by flexible tubing.

6. The inkjet printhead assembly of claim 1, wherein the compressible member comprises a bellows.

7. The inkjet printhead assembly of claim 6, wherein the compressible member further comprises a spring to assist the bellows in expanding after the bellows has been compressed.

8. The inkjet printhead assembly of claim 1, the array of nozzles and corresponding ink inlet of the printhead die being a first array of nozzles and corresponding first ink inlet, the ink chamber being a first ink chamber, the ink outlet of the first ink chamber being a first ink outlet, the membrane being a first membrane, the inkjet printhead assembly further comprising:

a) a second array of nozzles with a corresponding second ink inlet;

b) a second ink chamber including a second ink outlet that is fluidly connected to the second ink inlet corresponding to the second array of nozzles; and c) a second membrane that is permeable to air but is not permeable to liquid, wherein when the compressible member is expanding, a reduced air pressure is applied to the second membrane while the one-way relief valve is in its closed position.

9. The inkjet printhead assembly of claim 8, further comprising:

a first dismountable ink tank including a first port; and a second dismountable ink tank including a second port, wherein the first ink chamber further comprises a first inlet port that is fluidly connectable to the first port of the first dismountable ink tank, and wherein the second ink chamber further comprises a second inlet port that is fluidly connectable to the second port of the second dismountable ink tank.

10. The inkjet printhead assembly of claim 8, the compressible member of the air extraction chamber being compressible along a compression direction, wherein the second ink chamber is displaced from the first ink chamber along a direction that is substantially parallel to the compression direction.

11. The inkjet printhead assembly of claim 8, the first membrane and the second membrane being outermost membranes of a plurality of membranes, the compressible member being compressible along a compression direction, wherein a distance between an outermost edge of the first membrane to the opposite outermost edge of the second membrane is less than a dimension of the air extraction chamber along the compression direction.

12. The inkjet printhead assembly of claim 1, the array of nozzles being disposed along an array direction, wherein the compressible member of the air extraction chamber is compressible along a compression direction that is substantially perpendicular to the array direction.

13. The inkjet printhead assembly of claim 12, wherein the membrane is displaced from the array of nozzles along a direction that is substantially perpendicular to both the array direction and the compression direction.

14. The inkjet printhead assembly of claim 1, the ink chamber further comprising liquid ink, wherein the air extraction chamber is disposed above the ink outlet of the ink chamber so that air bubbles can freely rise through the liquid ink from the ink outlet of the ink chamber toward the air extraction chamber.

15. The inkjet printhead assembly of claim 1, the air extraction chamber including a time constant characterizing a decreasing difference between ambient pressure and a pressure within the air extraction chamber, wherein the time constant is greater than about 5 seconds and less than about one hour.

16. A gas and liquid container comprising:

a) a first portion including a supply opening for supplying the liquid therethrough;

b) a second portion including:

i) a first valved opening comprising a valve for releasing gas from the first portion;

ii) a second valved opening for releasing the gas therethrough under pressure, wherein the first valve prevents the gas under pressure from passing therethrough; and iii) a pressure opening for forcibly moving the gas out of the second portion of the container; and c) a compressible member coupled to the pressure opening and having a compressed position which, when in the compressed position, raises an air pressure in the second portion of the container and forcibly moves at least a portion of the gas out of the second portion of the container.

17. The container of claim 16, wherein the compressible member is spring biased for causing expansion of the compressible member.

18. The container of claim 16, wherein the compressible member is also expandable for extracting air from the first portion of the container during an expansion of the compressible member.

19. The container of claim 18, wherein the first portion and the second portion are separated by a membrane that is permeable to the gas, but not permeable to the liquid.

* * * * *